US005218915A

United States Patent [19]

Iwasaki et al.

[11] Patent Number: 5,218,915

[45] Date of Patent: Jun. 15, 1993

[54] WORKPIECE HOLDING DEVICE WITH FOLD MAINTAINING STOP AND RECESS

[75] Inventors: Toshiaki Iwasaki; Satoshi Morii, both of Nagoya; Hiroyuki Mitsui, Kasugai; Minoru Yamaguchi, Nagoya, all of Japan

[73] Assignee: Brother Kogyo Kabushiki Kaisha, Nagoya, Japan

[21] Appl. No.: 884,192

[22] Filed: May 18, 1992

[30] Foreign Application Priority Data

Jul. 15, 1991 [JP] Japan ..... 3-173860

[51] Int. Cl.[5] ..... D05B 3/00; D05B 35/06; D05B 21/00

[52] U.S. Cl. ..... 112/114; 112/121.15; 112/147; 223/38

[58] Field of Search ..... 112/104, 113, 114, 121.12, 112/262.3, 147, 148, 303, 311, 320, 235, 265.2, 121.15; 223/38

[56] References Cited

U.S. PATENT DOCUMENTS

| | | | |
|---|---|---|---|
| 4,497,269 | 2/1985 | Schneider et al. | 112/262.3 |
| 4,534,303 | 8/1985 | Off et al. | 112/114 |
| 4,664,046 | 5/1987 | Engle | 112/262.3 |
| 4,711,188 | 12/1987 | Yoneda | 112/113 X |
| 4,785,749 | 11/1988 | Fischer | 112/121.15 X |
| 4,821,659 | 4/1989 | Morii et al. | 112/121.15 |
| 5,014,633 | 5/1991 | Murata et al. | 112/121.12 |
| 5,052,316 | 10/1991 | Sakakibara | 112/121.15 |
| 5,058,517 | 10/1991 | Morii et al. | 112/147 X |
| 5,074,230 | 12/1991 | Morii et al. | 112/114 X |
| 5,081,944 | 1/1992 | Wakanishi | 112/121.15 X |
| 5,133,271 | 7/1992 | Iwasaki et al. | 112/147 X |

FOREIGN PATENT DOCUMENTS

| | | | |
|---|---|---|---|
| 2068880 | 9/1971 | France | 112/121.15 |
| 56-58003 | 5/1981 | Japan . | |
| 62-53602 | 11/1987 | Japan . | |
| 1319360 | 6/1973 | United Kingdom | 112/121.15 |
| 2245602 | 1/1992 | United Kingdom | 112/121.15 |

*Primary Examiner*—Clifford D. Crowder
*Assistant Examiner*—Ismael Izaguirre
*Attorney, Agent, or Firm*—Oliff & Berridge

[57] ABSTRACT

A workpiece fabric holding device for producing neatly folded pocket pieces for attachment to an article clothing. When a peripheral edge of a patch pocket P put on a gage plate at an operational position is folded back under the gage plate, a folded portion around the edge with a double folded portion formed at the corners of the patch pocket P. Then the gage plate is moved downward and the folded portion and the double folded portion are depressed to a cloth W positioned on a machine table. A hollow is formed on the machine table which opposes and receives the double folded portion. A stopper is arranged in the hollow to prevent the cloth of the folded portion or the double folded portion from being drawn out beyond the periphery of the patch pocket P.

20 Claims, 6 Drawing Sheets

WORKPIECE HOLDING DEVICE WITH FOLD MAINTAINING STOP AND RECESS

BACKGROUND OF THE INVENTION

1. Field of the Invention

The invention relates to a workpiece fabric holding device, and more particularly, to a pocket setter having a workpiece fabric holding device.

2. Description of Related Art

There is conventionally proposed a workpiece fabric holding device for the pocket setter. This kind of the workpiece fabric holding device is described, for example, in U.S. Pat. No. 4,821,659. In such a device, a patch pocket, as a workpiece fabric, is placed on a gage plate (which provides a pocket shape) arranged on an upper part of a machine table on which the cloth is placed. A holding plate is overlapped with the gage plate through the patch pocket placed thereon. Then, edge portions of the patch pocket are folded to the back side of the gage plate along its contour by moving a plurality of folders arranged on a folder base plate which is provided around the gage plate towards the gage plate. The patch pocket is then moved downward to the cloth with its edge portions being folded, and the folders and holding plate are retracted to their preparatory positions. A guide plate for stitching the patch pocket is placed on the patch pocket and is actuated to depress the patch pocket with the gage plate onto the cloth positioned on the machine table. Then, the gage plate is drawn back to be detached from the patch pocket. Under the condition that the patch pocket and the cloth are fixed on the table by the guide plate, the guide plate is set at the stitching point. Thus, the patch pocket is stitched on the cloth by relatively moving the guide plate and the sewing machine.

Moreover, there is a device for sewing the pocket, as shown in FIG. 6, the top of the folded portion thereof is turned down after being folded by the folder. This kind of workpiece fabric holding device is described, for example, in Japanese Patent Publication No. 62-53602.

The quality of the pocket is controlled by its folding condition. If the folded portion of the pocket is sewn leaving portions sticking out from the contour of the pocket, it looks poor and the product is of an inferior quality.

In the device for sewing the pocket having the folded portion, as shown in FIG. 6, essentially eliminated the portion from sticking out from the contour of the pocket. However, in the case where the material of the patch pocket was thick material or knit, it caused a problem in that the folded portion N, shown in FIG. 6, became bulky or the material being sewn was expanded.

In the pocket setter thus structured, the edge of the patch pocket is automatically folded along the contour of the gage plate and is stitched on the cloth with such the folded condition. At that time, when the angle between the side edge of the gage plate (side edge of the pocket) and the upper edge of the pocket placed on the gage plate is 90 degrees, the folded portion of the patch pocket formed by the folder moved under the gage plate does not stick out from the outer peripheral edge of the pocket. However, the folded patch pocket is then moved downward, onto the cloth seated on the machine table, with the gage plate. As a result, the folded portion is held between the gage plate and the machine table. The gage plate is then drawn back to be detached from between the patch pocket and the cloth seated on the machine table and the patch pocket is depressed by the guide plate for stitching the patch pocket. When the folding of the patch pocket is thus completed, as shown in FIG. 5, the folded portion M has been drawn out in the upper direction (to the side of the retracted position of the gage plate) from the upper edge of the patch pocket P by the retracting movement of the gage plate. Immediately after this retracting movement, the guide plate for stitching the patch pocket moves to the stitching position of the sewing machine head and stitching of the patch pocket starts. When the above mentioned drawing out of the folded portion M happens, the patch pocket has already been covered and depressed by the guide plate in preparation for stitching the patch pocket. Thus, the operator cannot confirm the upper edge of the pocket with his eyes and the stitching operation is started as it is. As a result, many inferior products are produced.

SUMMARY OF THE INVENTION

The invention addresses and solves the above problems. It is an object of the present invention to provide a workpiece fabric holding device which can prevent a folded portion of workpiece fabric from being drawn out from the contour of the workpiece fabric by the retracting movement of a gage plate, thereby preventing the production of products which looks have a poor appearance.

To achieve this object, the invention has a structure such that the workpiece holding device for a sewing machine, which is equipped with a table, having a gage plate movably supported on the table for upward and downward movements; a holding plate for holding a workpiece fabric placed on the gage plate; a plurality of folders supported by a folder base plate; and actuating means for actuating the gage plate, the holding plate and the folder base plate comprising: a stopper for restricting movement of a folded portion of the workpiece fabric when the gage plate moves from an operational position to a retracted position, the stopper being provided on the table between an upper edge of the workpiece fabric and the retracted position of the gage plate; and a hollow for holding a double folded portion of the workpiece fabric provided on the table and at a position facing the double folded portion.

With the structure of the invention, the peripheral edge of the workpiece fabric which sticks out from the contour of the gage plate on which the workpiece fabric is put, is folded towards the lower surface of the gage plate, and the folded portion of the workpiece fabric is thus prepared. Afterwards, the gage plate and the machine table relatively approach one another and the folded portion is held between the gage plate and the machine table. In the held condition, the guide plate is moved above the workpiece fabric and depressed onto the machine table and then the gage plate is retracted to its retracted position. At this time, movement of the folded portion of the workpiece fabric is restricted by the stopper and it is not drawn out to the side of the retracted position by the gage plate.

As is apparent from the above description, the stopper is provided for restricting the movement of the folded portion of the workpiece fabric at the time when the gage plate is moved from the operational position to the retracted position. The stopper is provided on the machine table between the upper edge of the workpiece fabric placed on the gage plate and the retracted position of the gage plate. Therefore, the device of the invention can prevent the folded portion of the workpiece fabric from being drawn out beyond the contour of the workpiece fabric by the retracting movement of the gage plate thereby preventing the production of products which look poor, such as pockets having edges that are sticking out.

BRIEF DESCRIPTION OF THE DRAWINGS

A preferred embodiment of the invention will be described in detail with reference to the figures wherein.

DESCRIPTION OF THE PREFERRED EMBODIMENTS

A preferred embodiment of the invention is set forth with reference to the attached drawings.

Figure 1:
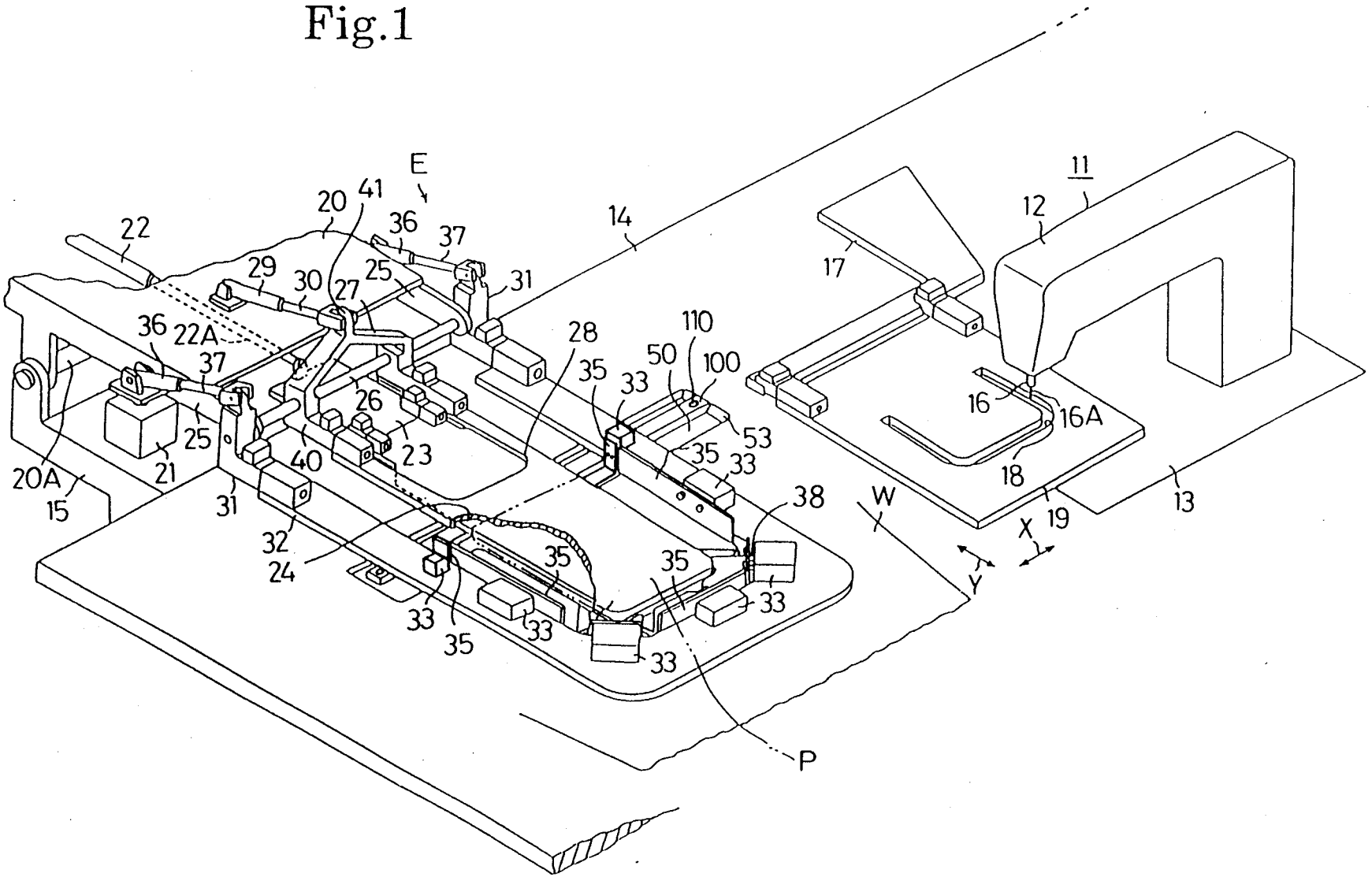
FIG. 1 is a perspective view of a workpiece fabric holding device and a sewing machine according to a preferred embodiment of the invention.

FIGS. 1–4 show an embodiment of the invention. As shown in FIG. 1, a sewing machine 11 includes a machine arm 12 and a machine bed 13. A needle bar 16 with a needle 16A at its lower end is attached to the machine arm 12 to be vertically movable. A loop taker (not shown) which cooperates with the needle 16A to form a stitch is installed within the machine bed 13.

A guide arm 17 is provided on the machine table 14. The guide arm 17 is movable along both the X and Y axes shown in FIG. 1. A guide plate 19, including a needle guide groove 18, is removably attached to the front part of the guide arm 17. The needle guide groove 18 extends through the guide plate 19. As to be explained with reference to FIGS. 4(A) through 4(G), a cloth W and a patch pocket P, to be stitched on the cloth W, are held on the machine table 14 by the guide plate 19. Under such a condition, a known stitch forming mechanism is started and the guide plate 19 is moved in the X and Y directions so that the needle moves along the needle guide groove 18. Thus, the patch pocket P is stitched onto the cloth W.

Figure 2A:
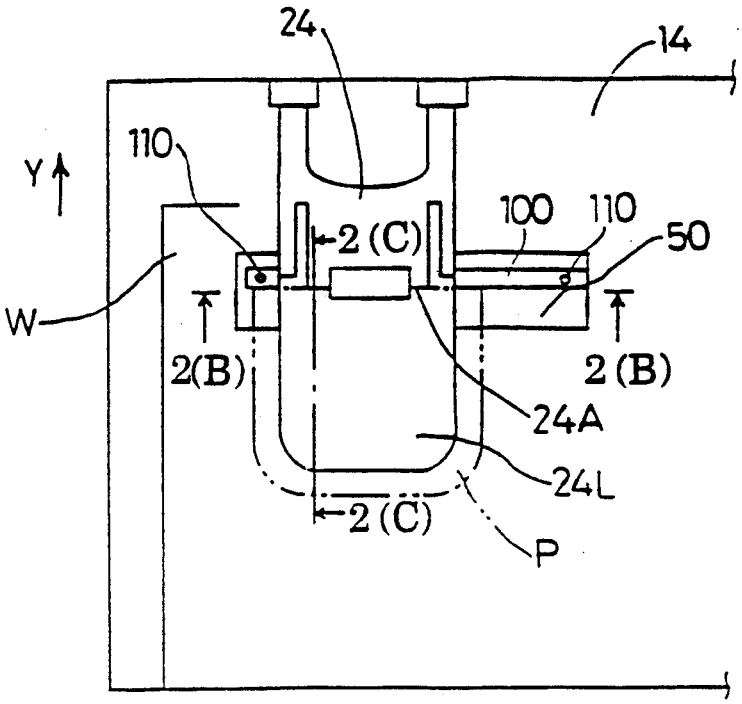
FIG. 2(A) is a plan view showing a position of a machine table, a hollow, and a gage plate according to a preferred embodiment of the invention.
Figure 2B:
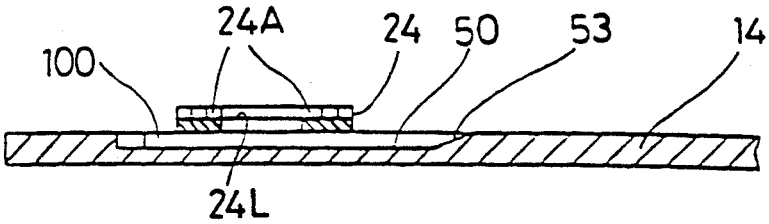
FIG. 2(B) is cross-sectional view taken along line 2(B)—2(B) of FIG. 2(A)

As shown in FIG. 1, a supporting member 20 is provided above a supporting base 15 projected from the machine table 14 to be rotatable around a horizontal axis 20A. The supporting member 20 is rotated based on the movement of an air cylinder 21 mounted on the supporting base 15. An air cylinder 22 including a piston 22A is provided under the supporting member 20. A gage plate supporter 23 is attached to the front end of the piston 22A and is positioned in the front of the supporting member 20. A gage plate 24, on which the patch pocket P is set for determining the contour of the pocket, is removably attached to the gage plate supporter 23. Therefore, the gage plate can be moved vertically with respect to the machine table 14 at the operational position, and also can be moved horizontally to the retracted position which is under the supporting member 20 by the air cylinder 22. The gage plate 24 is formed like stairs as shown in FIGS. 2(A) and 2(B). The front portion thereof is formed as a putting surface 24L on which the patch pocket P is put and a riser, which is perpendicular to the putting surface 24L, is formed as a positioning surface 24A for deciding the setting position of the patch pocket P. The putting surface 24L and the positioning surface 24A are omitted from FIG. 1 to simplify the drawings.

A pair of arms 25 project in parallel from both edges of the front end of the supporting member 20. An axel 26 extends between the arms 25 at a right angle to them. A holding plate supporter 27 is attached to the axel 26 to be rotatable around the axel 26. Moreover, a holding plate 28 is removably attached to the holding plate supporter 27 by a pair of attaching members 40 which extend from the holding plate supporter 27. A connecting head 41 projects from the center of the upper side of the holding plate supporter 27 and is connected to a piston 30 of an air cylinder 29 which is, in turn, rotatably attached to the upper surface of the supporting member 20. The piston 30 functions to pivotally move the holding plate 28 between a preparatory position above the gage plate 24 and an operational position on the gage plate 24.

Both ends of the axel 26 are supported by the pair of arms 25. A pair of supporting blocks 31 are pivotally supported on the ends of the axel 26 that extend outwardly from the arms 25. A U-shaped folder base plate 32 is removably attached to the front end of the supporting blocks 31. The front end of the holding plate 28 is surrounded by seven air cylinders 33, which include pistons 38, that are mounted on the folder base plate 32. Each piston 38 is equipped with a folder 35 which is moved between the operational position under the gage plate 24 and the preparatory position apart from the gage plate 24 by actuating the piston 38.

On the other hand, the upper end of the supporting blocks 31 and the supporting member 20 are connected by a pair of air cylinders 36 including pistons 37. The base of one of the cylinders 36 is pivotally attached to each side of the supporting member 20. Each piston 37 is connected to the upper end of an associated one of the blocks 31. A driving device E (not shown) is provided for moving the gage plate 24, the holding plate 28, and the folder base plate 32 between the operational position approaching the machine table 14 and the preparatory position apart from the machine table 14 by actuating the appropriate air cylinders 21, 22, 29, and 36.

Figure 3A:
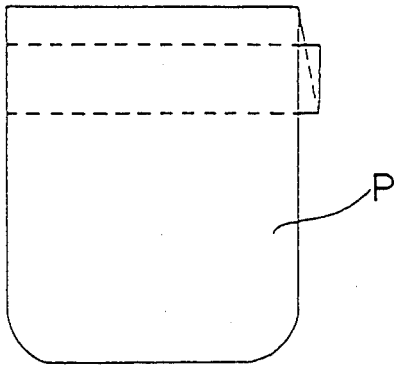
FIGS. 3(A) and (B) illustrate the double folded portion of a patch pocket.
Figure 3B:
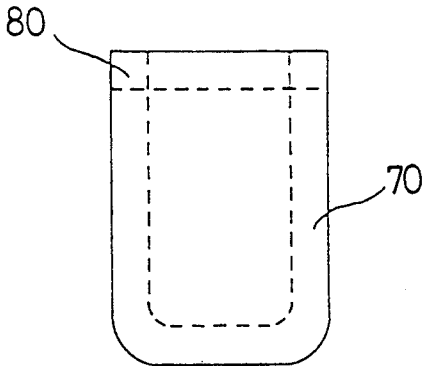

For stitching the patch pocket P, generally, the upper edge of the patch pocket P is folded over twice as shown in FIG. 3(A). Then the peripheral edge, including the folded upper edge, is folded as shown in FIG. 3(B). The patch pocket thus folded has a folded portion 70, where only the upper edge or the peripheral edges of the patch pocket P are folded, and a double folded portion 80, where the folded portions 70, are further folded and whose thickness is more than that of the folded portions 70.

The patch pocket P whose upper edge is folded is positioned on the putting surface 24L so that the upper edge touches the positioning surface 24A of the gage plate 24. The patch pocket P thus positioned on the gage plate 24 is folded by a process to be explained below and is overlapped on the cloth W.

In the invention, a hollow 50 is provided on the machine table 14 to be faced to the double folded portion 80. The hollow 50 has a depth capable of holding the double folded portion 80 with the gage plate 24 when the folded portion 70 is held between the gage plate 24 and the machine table 14. The depth of the hollow 50 is adjustable in order to hold any double folded portions regardless of their varied thickness. The adjustability is provided by a movable hollow bottom plate that may be moved upwardly or downwardly by means such as a screw adjustment or a cam (not shown). The hollow 50 has a width and a length capable of not exposing the double folded portion 80 when the double folded portion 80 is held between the gage plate 24 and the hollow 50.

Further, the hollow 50 has an inclined guide portion 53 at the side of the sewing machine 11 so that the bottom surface of the hollow 50 slopes upwardly towards the surface of the machine table 14.

Further, a stopper 100, which extends in the X direction, is fixed by screws 110 to the bottom surface of the hollow 50 so that the upper surface of this stopper 100 lies in the same plane as the machine table surface. The position of the stopper 100 can be adjusted in the Y direction and the height of the stopper 100 can be adjusted by changing stoppers based on the depth of the hollow 50, namely according to the thickness of the double folded portion.

Figure 4A:
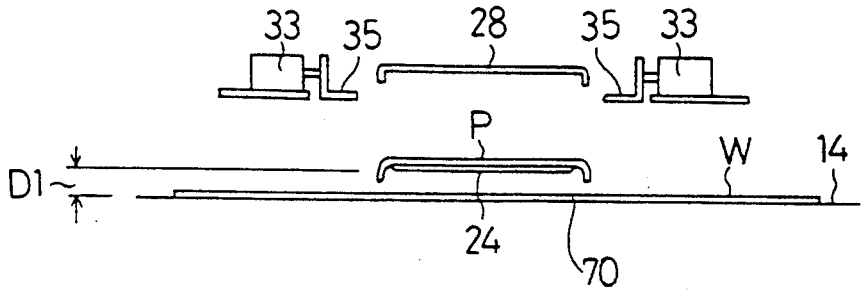
FIGS. 4(A) through 4(H) illustrate steps of the process of folding the peripheral edge of a patch pocket by the folding device of the invention.

The processes for stitching the patch pocket P onto the cloth W using the pocket folding device of the invention and a sewing machine is as follows. First, the gage plate 24, the holding plate 28 and the folder base plate 32 are raised with the supporting plate 20 so that the gage plate 24 is set at the preparatory position at a distance D1 apart from a surface of the machine table 14 as shown in FIG. 4(A).

Then the air cylinders 29 and 36 are actuated to raise the holding plate 28 and the folder base plate 32. Under this condition, the cloth W is placed on the table 14 under the gage plate 24, and the patch pocket P is positioned on the gage plate 24, with the upper edge of the patch pocket P being folded to three thicknesses as shown in FIG. 3(A), and positioned by the positioning surface 24A as shown in FIG. 2(A). At this time, the peripheral edge of the patch pocket P extends beyond the gage plate 24 edges.

Figure 4B:
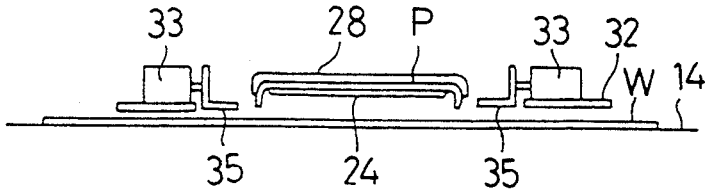

Next, the piston 30 of the air cylinder 29 is actuated to lower the holding plate 28 so that the holding plate 28 overlaps the gage plate 24 with the patch pocket therebetween. Thus, the peripheral edge of the patch pocket P is folded downward along the contour of the gage plate 24 as shown in FIG. 4(B). At this time, the piston 37 of the air cylinder 36 is actuated to lower the folder base plate 32 and the folder base plate 32 is moved to a level lower than the gage plate 24. Further, it is possible to adjust the position of the folder 35 corresponding to the depth of the hollow 50 so that it is lower than the position of the other folders 35.

Figure 4C:
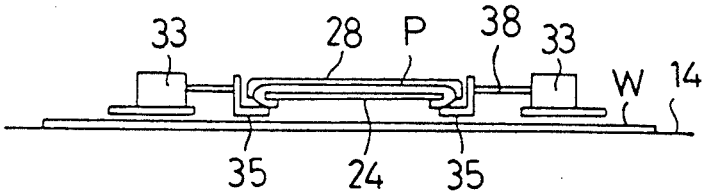

After that, the folders 35 are inserted under the gage plate 24 as illustrated in FIG. 4(C) by actuating each piston 38 of each air cylinder 33 so that the peripheral edge of the patch pocket P is folded back and under the gage plate 24. By this folding, the double folded portion 80 is formed at the corner of the patch pocket P because the upper edge of the patch pocket P has already been folded at the beginning of the process. At this time, the double folded portion 80 and the folded portion 70 of the patch pocket P are held between the folders 35 and the gage plate 24.

Figure 4D:
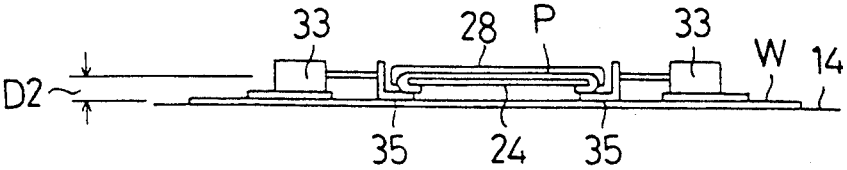
Figure 4:
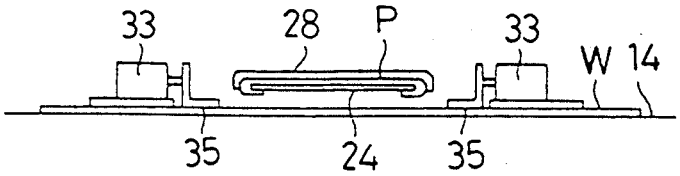

Next, as shown in FIG. 4(D), the gage plate 24, the holding plate 28 and the folder base plate 32 are lowered with the supporting member 20 so that the distance D2 between the surface of the machine table 14 and the gage plate 24 becomes smaller than the distance D1 shown in FIG. 4(A). Subsequently, the air cylinders 33 are actuated to return the folders 35 to the preparatory position as shown in FIG. 4(E). The double folded portion 80 and the folded portion 70 can be depressed with the same pressure to the machine table 14, so that the folder 35 does not draw out a part of the folded portion 70 or the double folded portion 80 outside of the patch pocket P as defined in gage plate 24.

Figure 4F:
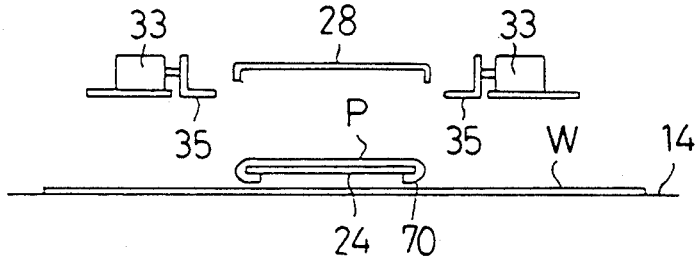
Figure 4:
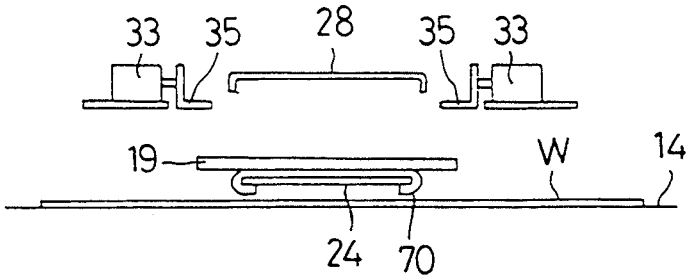
Figure 4:
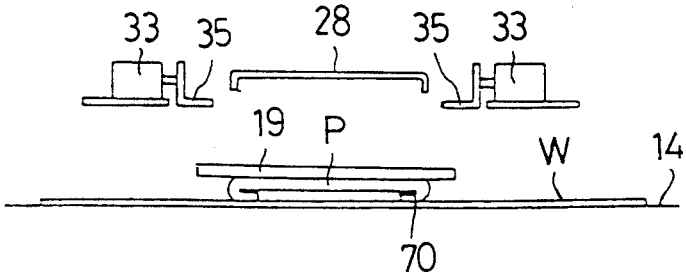
Figure 5:
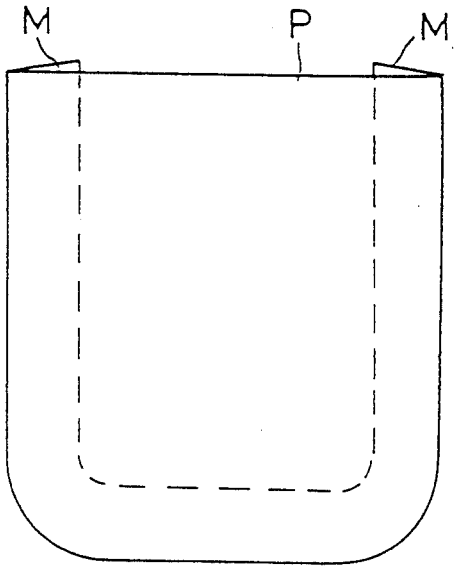
Fig.5 RELATED ART
FIG. 5 illustrates a pocket whose folded edges stick out as stitched by a conventional device.
Figure 6:
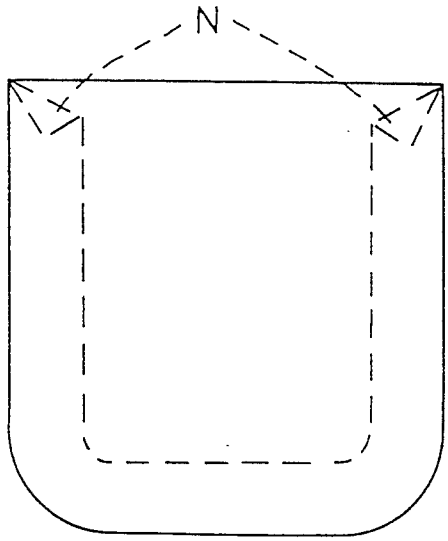
Fig.6 RELATED ART
FIG. 6 illustrates a pocket whose folded edges are turned down by the conventional device.

Then, the folder base plate 32 and the holding plate 28 are raised by actuating the air cylinders 29 and 36 to keep them away from the patch pocket P as shown in FIG. 4(F).

Figure 2C:
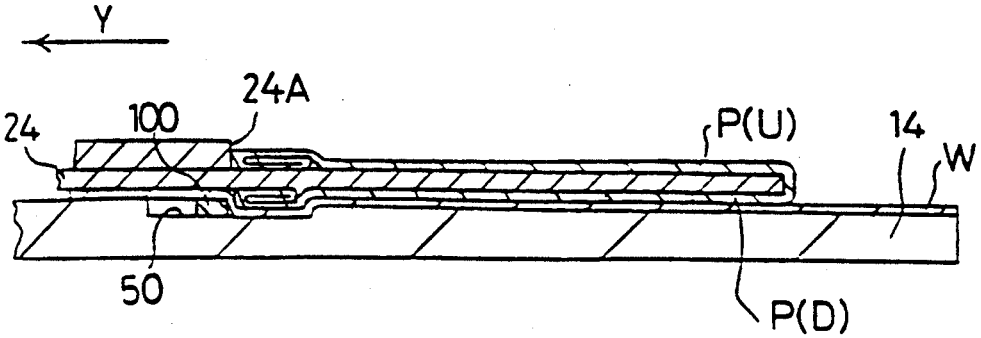
FIG. 2(C) is cross-sectional view taken along line 2(C)—2(C) of FIG. 2(A)

Under the above mentioned condition, the guide plate 19 is placed over the patch pocket P and is actuated to depress the patch pocket P, with the gage plate 24, onto the cloth W as illustrated in FIG. 4(G). Then, the cloth W and the double folded portion 80 of the patch pocket P that are between the hollow 50 and the gage plate 24 are held by the hollow 50 and the gage plate 24 and the cloth W and the folded portion 70 of the patch pocket P are held by the machine table 14 and the gage plate 24. At this time, the thickness of the double folded portion 80 can be accommodated by the hollow 50, as shown in FIG. 2(C), so that the upper surfaces of the folded portion 70 and the double folded portion 80 contacting with the gage plate 24 become flat and are held by the gage plate 24 without any space.

Next, by actuating the piston 22A of the air cylinder 22, the gage plate 24 is drawn back to be detached from the patch pocket P as shown in FIG. 4(H). When the gage plate 24 is moved to its retracted position, the folded portion 70 or the double folded portion 80 is not separated from the machine table 14 because the folded portion 70 and the double folded portion 80 had been held by the gage plate 24 without any space, and the folded portion 70 or the double folded portion 80 is not drawn into the center of the patch pocket P which would reduce the size of the pocket opening. The movement of the gage plate 24 to its retracted position causes the double folded portion 80 to be slightly moved toward the retracted position side to touch the stopper 100 through the cloth W at which point the movement of the double folded portion 80 is restricted. At this time, the upper or outer side of the patch pocket P(U) is also slightly moved toward the retracted position side. Therefore, it is positively prevented that the double folded portion 80 (the under folded side of the patch pocket P(D)) sticks out from the upper edge of the patch pocket P.

Under the condition that the patch pocket P and the cloth W are fixed on the surface of the machine table 14 by the guide plate 19, the guide plate 19 is set at the stitching point. Thus, the patch pocket P is moved in the X and Y directions based on the sewing data and is stitched onto the cloth W by the sewing machine. During the movement to the stitching point of the guide plate 19, by which the cloth W and the patch pocket P are fixed, the double folded portion 80 can be smoothly guided by the inclined portion 53 provided in the hollow 50.

It is to be understood that the present invention is not restricted to the particular forms shown in the foregoing embodiment, and various modifications and alterations can be added thereto without departing from the scope of the invention encompassed by the appended claims.

For instance, in the above mentioned embodiment the stopper 100 is arranged in the hollow 50, but it is not necessary to arrange it therein. The stopper is necessary in the hollow when the cloth thickness of the patch pocket is large and the double folded portion exists. But it is not necessary to arrange the stopper in the hollow and it is possible to place the stopper directly on the machine table if the difference of the thickness between the folded portion and the double folded portion is negligible, for example, with the thin cloth used for a dress shirt.

Further, it is possible to provide the stopper on the surface of the machine table so as to be projected and retracted. When the gage plate is moved to its retracted position, the stopper is projected on the surface of the machine table. However, on moving to the stitching position with the guide plate, the stopper is retracted under the surface of the machine table in order not to obstruct the movement.

What is claimed is:

1. A workpiece holding device for a sewing machine, which is equipped with a table, a gage plate movably supported on the table for upward and downward movements, a holding plate for holding a workpiece fabric put on the gage plate, a plurality of folders supported by a folder base plate, and actuating means for actuating the gage plate, the holding plate and the folder base plate, comprising:

a stopper for restricting movement of a folded portion of the workpiece fabric when the gage plate moves from an operational position to a retracted position, the stopper provided on the table between an upper edge of the workpiece fabric and the retracted position of the gage plate; and a hollow for receiving a double folded portion of the workpiece fabric, which is provided on the table and at the position facing to the double folded portion.

2. The workpiece fabric holding device for a sewing machine as claimed in claim 1, wherein said hollow has an inclined guide portion at a side toward the sewing machine such that a bottom surface of said hollow slopes upward towards a surface of the machine table.

3. The workpiece fabric holding device for a sewing machine as claimed in claim 1, wherein the depth of said hollow is adjustable.

4. The workpiece fabric holding device for a sewing machine as claimed in claim I, wherein the height of said stopper is adjustable.

5. The workpiece holding device as claimed in claim 4, wherein said stopper is provided in said hollow.

6. The workpiece holding device as claimed in claim 5, wherein a height of said stopper is the same as a depth of said hollow.

7. The workpiece holding device as claimed in claim 1, wherein said hollow has a width and length so that the double folded portion is not exposed when the double folded portion is held between the gage plate and the hollow.

8. The workpiece holding device as claimed in claim 1, wherein an upper surface of said stopper lies in the same plane as a surface of the table.

9. The workpiece holding device as claimed in claim 1, wherein a folder of the plurality of folders corresponding to said hollow is positioned lower than a position of the other folders.

10. The workpiece holding device as claimed in claim 9, wherein the folder corresponding to said hollow is positioned lower such that the folded portion and the double folded portion are held with the same pressure between the folder and the gage plate.

11. The workpiece holding device as claimed in claim 1, wherein said hollow accommodates the double folded portion such that upper surfaces of the folded portion and the double folded portion contacting with the gage plate become flat.

12. The workpiece holding device as claimed in claim 9, wherein each of the upper surfaces lies flat against the gage plate.

13. A workpiece holding device for a sewing machine, comprising:

a table;

a gage plate movable between an operational position on the table and a retracted position remote from the table;

a holding plate movable upward and downward for holding a workpiece put on the gage plate;

a plurality of folders, movable between an operational position adjacent the table and a preparatory position apart from the table, for folding a peripheral edge of the workpiece back and under the gage plate;

a stopper for restricting movement of a double folded portion of the workpiece when the gage plate moves from the operational position to the retracted position; and a concave portion for holding the double folded portion of the workpiece.

14. The workpiece holding device as claimed in claim 13, wherein said concave portion is provided on the table and accommodates the double folded portion.

15. The workpiece holding device as claimed in claim 14, wherein said concave portion accommodates the double folded portion which is provided lower than the gage plate when the gage plate is at the operational position.

16. The workpiece holding device as claimed in claim 13, wherein said stopper is provided in said concave portion.

17. The workpiece holding device as claimed in claim 16, wherein a side of said stopper toward the operational position of the gage plate is facing to the double folded portion of the workpiece.

18. The workpiece holding device as claimed in claim 17, wherein said side restricts movement of the folded portion by limiting movement of the double folded portion when the gage plate moves to the retracted position.

19. The workpiece holding device as claimed in claim 13, the gage plate has a positioning surface on an upper side where the double folded portion is positioned when the gage plate is at the operational position.

20. The workpiece holding device as claimed in claim 19, wherein a height of the positioning surface is higher than a height of the double folded portion.

* * * * *